United States Patent [19]

Rogers

[11] 4,190,752

[45] Feb. 26, 1980

[54] VACUUM ACTUATED SWITCH

[75] Inventor: David W. Rogers, Rochester, N.Y.

[73] Assignee: General Motors Corporation, Detroit, Mich.

[21] Appl. No.: 963,002

[22] Filed: Nov. 22, 1978

[51] Int. Cl.[2] ..... H01H 35/34

[52] U.S. Cl. ..... 200/81.5; 200/83 P; 200/83 Y; 200/83 Q

[58] Field of Search ..... 74/645, 731; 200/81 R, 200/81.5, 61.89, 86.5, 83 P, 83 Y, 83 Q

[56] References Cited

U.S. PATENT DOCUMENTS

| | | | |
|---|---|---|---|
| 3,252,352 | 5/1966 | General et al. | 74/645 |
| 3,596,023 | 7/1971 | Kothe | 200/83 P |
| 3,693,478 | 9/1972 | Malloy | 74/645 |
| 4,140,436 | 2/1979 | Schumacher et al. | 200/83 Q |

*Primary Examiner*—Gerald P. Tolin
*Attorney, Agent, or Firm*—Donald F. Scherer

[57] ABSTRACT

A vacuum actuated switch has a pair of snap action contacts which are actuated in response to the operation of two vacuum motors. One vacuum motor controls the opening and closing of the contacts in a first predetermined range of vacuum. The other vacuum motor extends the range of operation to a second and larger predetermined range of vacuum wherein one limit of the second range is the same as the first range.

4 Claims, 5 Drawing Figures

VACUUM ACTUATED SWITCH

This invention relates to switch mechanisms and more particularly to vacuum actuated switch mechanisms.

It is an object of this invention to provide an improved vacuum actuated switch having two ranges of operation.

Another object of this invention is to provide an improved vacuum operated switch having a first vacuum motor which operates the switch to open and close in one operating range of vacuum and a second vacuum motor which controls an atmospheric inlet to the first motor whereby the operating range is altered when the vacuum exceeds a predetermined level.

A further object of this invention is to provide an improved vacuum actuated switch having a first vacuum motor operable to close the switch at a first vacuum level and to open the switch at a second and higher vacuum level, and also having a second vacuum motor operable to connect atmospheric pressure to the first motor whereby the switch is closed by the first motor at a third and still higher vacuum level and wherein the second vacuum motor is operable to disconnect atmospheric pressure from the first vacuum motor on a decrease in vacuum below the third level so that the first vacuum motor will maintain the switch open until the first level of vacuum is reached.

These and other objects and advantages of the present invention will be more apparent from the following description and drawings in which.

Figure 1:
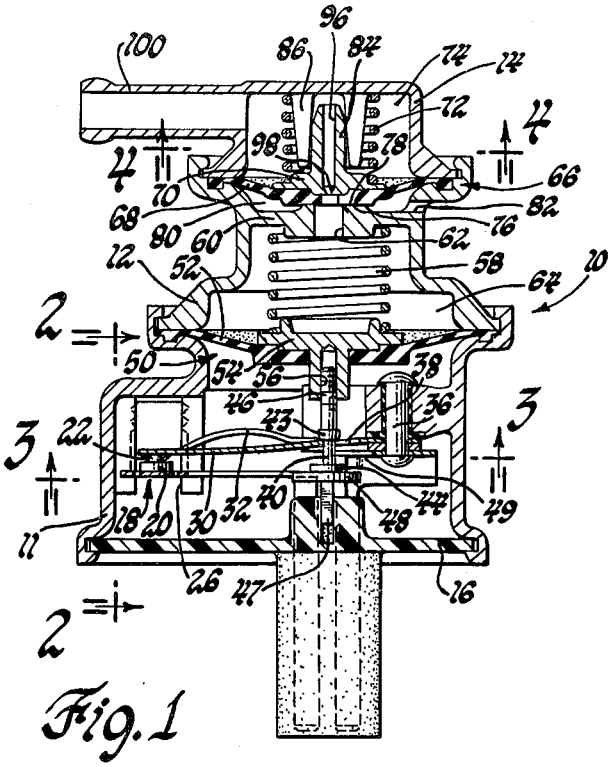
FIG. 1 is an elevational view in cross section showing a vacuum actuated switch mechanism incorporating the present invention.
Figure 2:
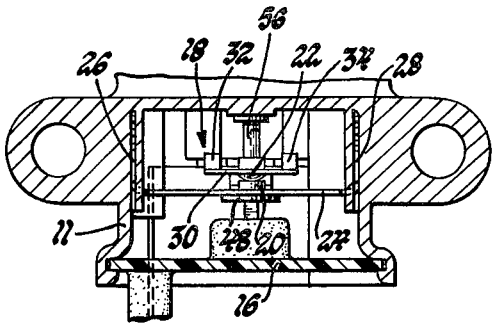
FIG. 2 is a sectional view taken along line 2—2 of FIG. 1.
Figure 3:
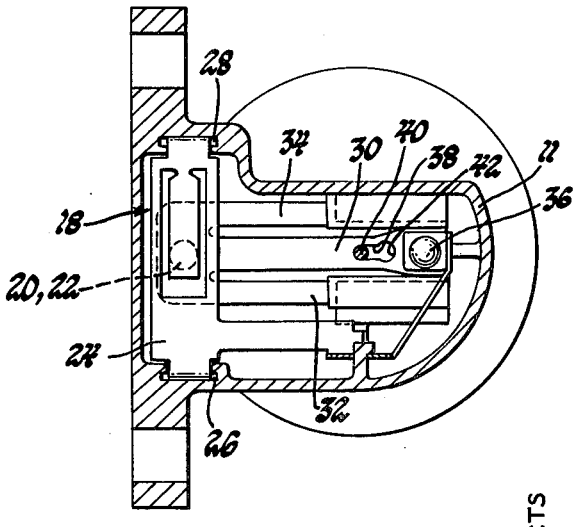
FIG. 3 is a sectional view taken along line 3—3 of FIG. 1.
Figure 4:
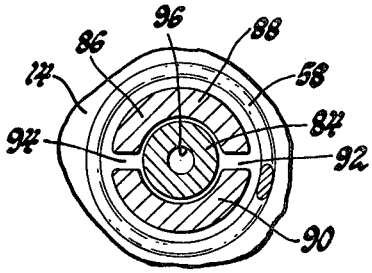
FIG. 4 is a sectional view taken along line 4—4 of FIG. 1.

Referring to the drawings, there is seen in FIG. 1 a vacuum actuated switch generally designated 10 which has a lower housing portion 11, an intermediate housing portion 12 and an upper housing portion 14. The lower housing portion 11 is closed by an end cap 16 and houses an electrical switch generally designated 18 which consists of a stationary electrical contact 20 and a movable electrical contact 22. The stationary contact 20 is bonded or otherwise affixed to a U-shaped member 24 which is secured in slots 26 and 28 formed in the lower housing 11.

The movable contact 22 is secured to a flexible blade 30 which has formed integrally therewith a pair of snap spring arms 32 and 34. One end of the flexible blade 30 is attached to the lower housing 11 by a rivet 36 and the blade 30 has formed therein an elongated opening or slot 38 through which extends a switch actuating pin 40. The elongated slot 38 has an enlarged opening 42 formed at one end thereof to permit assembly of the pin 40 into operating relation with the flexible blade 30.

The pin 40 has an enlarged central section 43, shown in FIG. 1, which abuts the flexible blade 30 in the switch closed position. A stop portion 48, an actuating portion 44 and a square extension 47 are formed on one end of the pin 40 while the other end 46 of the pin 40 is threaded. The square extension 47 is guided in a square recess formed in cap 16. The stop portion 48 will abut surface 49 immediately after the contacts 20 and 22 are opened by actuating portion 44. The threaded end 46 permits adjustment to establish the position of pin 40 at which the switch contacts 20 and 22 are opened and further upward movement of pin 40 is prevented by stop portion 48.

The threaded end 46 of pin 40 is connected to a vacuum motor generally designated 50 which consists of a flexible diaphragm 52 and a spring seat 54. The flexible diaphragm 52 is secured between the lower housing 11 and the intermediate housing 12 during assembly. The spring seat 54 has an internally threaded portion 56 which cooperates with the threaded end 46 of pin 40. The vacuum motor 50 also includes a compression spring 58 which is compressed between the spring seat 54 and an end wall 60 which is formed integrally with the intermediate housing 12. The spring 58 is operable to urge the motor 50 in a downward direction, as viewed in FIG. 1, to enforce closing of the switch contacts 20 and 22. A fluid passage 62 is formed centrally in the wall 60 which permits the chamber 64 formed by the diaphragm 52, housing 12 and wall 60 to receive the fluid signals necessary to operating the motor 50.

Another fluid motor 66 is also incorporated into the vacuum actuated switch 10 and includes a flexible diaphragm 68, a spring seat 70 and a compression spring 72. The flexible diaphragm 68 is secured between the intermediate housing portion 12 and the upper housing portion 14 during assembly and cooperates with the upper housing portion 14 to form a fluid chamber 74. The compression spring 72 is compressed between the upper housing 14 and the spring seat 70 to urge the flexible diaphragm 68 in a downward direction, as viewed in FIG. 1, to enforce abutment between the lower surface 76 of diaphragm 68 and an annular surface 78 of the wall 60. The surfaces 76 and 78 cooperate to form a valve mechanism which controls fluid flow through the passage 62 as will be later described. The diaphragm 68 also cooperates with intermediate housing 12 to form a chamber 80 which is communicated to atmosphere through an atmospheric opening or bleed orifice 82. The spring seat 70 has a cylindrical portion 84 which is disposed in a guide 86 formed integrally with the upper housing 14. The guide 86 has two substantially semicylindrical walls 88 and 90 between which are formed flow passages 92 and 94 which permit fluid communication between a passage 96 formed in the spring seat 70 and the chamber 74. The passage 96 has formed at one end thereof a restricted opening 98.

The upper housing 14 has formed integrally therewith a fluid connector 100 which is adapted to be connected to a vacuum source such as an engine manifold, not shown. The pressure in chamber 74 is therefore substantially equal to the pressure at the vacuum source such that the engine manifold vacuum will be operable to control the movement of diaphragm 68 in opposition to the force of spring 72. With the position of motor 66 as shown in FIG. 1, the vacuum level present in the chamber 74 operates through passages 92 and 94, passage 96, restriction 98 and passage 62 and therefore the chamber 64. Thus, in the position shown, the diaphragm 52 is responsive to the vacuum level of the source to move in opposition to the force in spring 58 when the vacuum level in chamber 64 is sufficient to create a pressure differential across diaphragm 52 which will result in a force sufficient to overcome the force in spring 58.

There is also a pressure differential present in the diaphragm 68 since the chamber 80 is maintained at atmospheric pressure and the chamber 74 is maintained at the vacuum level present in the vacuum source. When this pressure differential becomes sufficiently large, the diaphragm 68 will move upwardly against the force in spring 72 thereby opening the passage 62 to the atmospheric pressure in chamber 80 such that atmospheric pressure will be present in chamber 64 thereby balancing the pressure on diaphragm 52 so that the spring 58 will move the contacts 20 and 22 to the closed position.

Assuming the vacuum actuated switch 10 is connected to an engine inlet manifold and that the engine is operating at an idle or closed throttle condition, the vacuum present in chamber 74 will be at a maximum value which, as is well known, is greater than 17 in. hg. The motor 66 is preferably designed to be operable to move the diaphragm 68 against the force in spring 72 when the vacuum level in chamber 74 is equal to or greater than 17 in. hg. Therefore, the diaphragm 68 is moved upwardly to permit atmospheric pressure in chamber 80 to be transmitted to chamber 64. At this time, the diaphragm 52 of motor 50 has atmospheric pressure on both sides thereof so that the spring 58 and spring arms 32 and 34 will maintain the switch contacts 20 and 22 in the closed condition. This condition is seen at the far right of the graph shown in FIG. 5.

Since it is desirable to provide some hysteresis for the opening and closing of passage 62, the area of the circle formed by annular surface 78 and passage 62 is designed such that the effective operating area of the lower side of diaphragm 68 changes when the motor 66 is operated. Therefore, the passage 62 is opened at 17 in. hg., however, the motor 66 will not be operable to close the passage 62 until the vacuum level decreases slightly below 17 in. hg. As the diaphragm 68 is moved upwardly, the surface area, upon which atmospheric pressure is operable, increases resulting in an increase in the upward force on diaphragm 68. Thus the upward force required to maintain the diaphragm 68 in the upward position is less than the vacuum level necessary to enforce initial upward movement of the diaphragm 68 since the force in spring 72 remains substantially constant.

When the vacuum in chamber 74 decreases sufficiently to permit the passage 62 to be closed, the vacuum signal is transmitted to chamber 64 through passages 96 and 62. The vacuum motor 50 is designed to enforce upward movement of the pin 40 when the motor 66 is in the downward position and the vacuum of the source is greater than a predetermined value, for example, 7 in. hg. Thus, when the motor 66 closes passage 62, the diaphragm 52 of motor 50 will move upwardly so that the end 44 of pin 40 can engage the underside of flexible blade 30 and cause the flexible blade 30 to move upwardly against the force in spring arms 32 and 34. The spring arms 32 and 34 are of the snap action type, such that after a predetermined amount of movement, the spring force reverses direction and moves the spring contacts rapidly in the opening direction.

If the vacuum level in chamber 54 continues to decrease (approach atmospheric), the downward force in spring 58 will become sufficient to overcome the upward pressure differential force on diaphragm 52 and the switch opening force in spring arms 32 and 34. Therefore, at some vacuum level, for example, 2 in. hg., the forces on motor 50 will be sufficient to cause the spring contacts 20 and 22 to be closed. As the spring contacts close, the force in spring arms 32 and 34 is reversed to be in a spring closing direction thus preventing hunting of the spring contacts. Thus, there is a range of vacuum between atmospheric pressure and 2 in. hg. during which the contacts 20 and 22 will remain closed.

Figure 5:
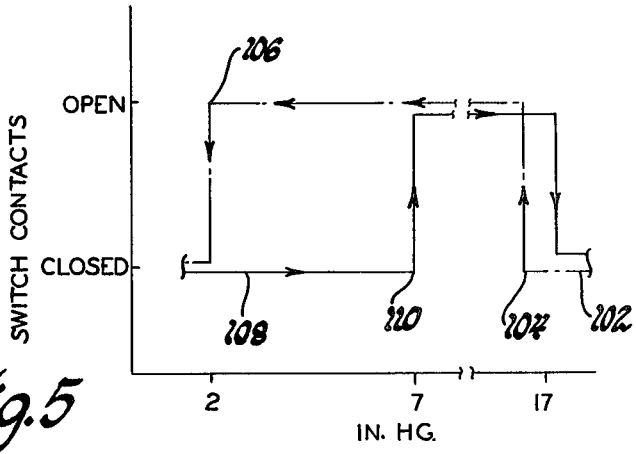
FIG. 5 is a graph depicting the operating ranges of the switch mechanism.

The vacuum actuated switch 10 has been found to be useful in controlling the engagement and disengagement of a torque converter clutch which is part of a motor vehicle drive system. In the operating of the torque converter clutch, it is desirable to have the clutch disengaged at engine idle or closed throttle condition, and at high torque or full throttle condition. Intermediate these operating conditions, it is desirable to have the clutch engaged thereby improving the vehicle drive line efficiency. The switch may be incorporated into a control system such as that shown in U.S. Pat. No. 3,693,478 issued Sept. 26, 1972, to John Malloy, and wherein such control systems are operable to control a lock-up clutch such as that shown in U.S. Pat. No. 3,252,352 issued May 24, 1966, to General et al. The graph shown in FIG. 5, depicts the operating range desired in such systems. When the switch contacts 20 and 22 are closed, the clutch is disengaged.

Referring to the graph of FIG. 5 and beginning at the far right thereof, the manifold vacuum is represented by line 102 when the vehicle is started and the throttle is closed creating an idle condition. As the operator depresses the throttle pedal, the vacuum level will decrease (approach atmospheric) until point 104 is reached at which time motor 66 will close the passage 62 thus creating a vacuum level in chamber 64 which is sufficient to operate vacuum motor 50 to open the switch contacts 20 and 22 thereby engaging the clutch. The switch contacts 20 and 22 will remain open until the engine manifold vacuum reaches point 106 at which time the vacuum level in chamber 64 will not be sufficient to maintain the switch contacts open and the switch will close disengaging the clutch. This vacuum change is the result of the operator depressing the throttle pedal. If the operator should release the throttle pedal after point 106 is reached, the manifold vacuum will return along line 108 and the switch contacts 20 and 22 will remain closed until point 110 is reached. At point 110, the vacuum level in chamber 64 is sufficient to operate the motor 50 to open the switch contacts 20 and 22. The switch contacts 20 and 22 will remain open as long as the vacuum level remains in a range less than 17 in. hg. or greater than 2 in. hg. This range, of course, will cover a substantial portion of the engine operating range. If, due to vehicle driving conditions, the switch contacts have been closed because engine manifold pressure reached point 106 (2 in. hg.) and it is necessary to maintain sufficient throttle opening so that the manifold pressure does not increase above 7 in. hg., the switch contacts 20 and 22 will remain closed in this range so that inherent slip characteristics of the torque converter will be available to the operator and engine lugging will not occur at the high torque output required by the vehicle.

It should be obvious that the vacuum operating switch will be found to be useful in any system which requires two operating ranges because of various system conditions which may be present. The operating ranges may be varied from those shown in FIG. 5 by controlling the various spring forces, restriction sizes and the area formed by annulus 78 and passage 62. The hysteresis between 2 in. hg. and 7 in. hg. can be controlled by the spring arms 32 and 34 and the hysteresis of switching operation around 17 in. hg. can be controlled by the area of annulus 78 and passage 62. The particular opening and closing points desired can be controlled by the area of the diaphragms 52 and 68 and by the force in springs 58 and 72. Thus, it is seen that a wide range of operation and variations in operation is available.

The embodiments of the invention in which an exclusive property or privilege is claimed are defined as follows:

1. A vacuum actuated snap action switch comprising; a pair of electrical switch contacts, a snap action spring having two positions to engage and disengage said contacts, a variable level vacuum source, first and second vacuum motors connected to said vacuum source, fixed restriction means intermediate said first vacuum motor and said vacuum source, means connecting said first vacuum motor to said snap action spring for moving the same between its two positions to operate said switch in response to a change in the level of said vacuum source between first and second vacuum levels, an atmospheric bleed orifice for said first vacuum motor, and valve means operated by said second vacuum motor responsive to variations in the level of said vacuum source above said second level for connecting and disconnecting said first vacuum motor and said atmospheric bleed orifice to shift the vacuum operating range of said first vacuum motor during variations in the level of said vacuum source above said second level.

2. A vacuum actuated snap action switch comprising; first and second electrical switch contacts; snap action spring means connected to one of said switch contacts and having a first position urging said one switch contact into closing relation relative to said other switch contact and a second position urging said one switch contact into an open relation relative to said other switch contact; first vacuum motor means connected to said snap action spring and being responsive to a source of vacuum for moving said spring to said first position at a first predetermined vacuum level and for moving said spring to said second position at a second predetermined vaccum level higher than said first predetermined vacuum level when the vacuum level is increasing from said first predetermined level to said second predetermined level; and second vacuum motor means responsive to a higher vacuum level than said first vacuum motor for connecting said first vacuum motor means to atmospheric pressure through a fixed bleed orifice for causing said first vacuum motor means to move said snap action spring to said first position at a third predetermined vacuum level higher than said second predetermined level and for connecting said first vacuum motor to the vacuum source to cause said first vacuum motor to move said snap action spring to said second position when the vacuum level is decreasing from said third predetermined level to said first predetermined level.

3. A vacuum actuated snap action switch comprising; a pair of electrical switch contacts, a snap action spring having two positions to engage and disengage said contacts, a variable level vacuum source, first and second vacuum motors connected to said vacuum source, fixed restriction means intermediate said first vacuum motor and said vacuum source, means connecting said first vacuum motor to said snap action spring for moving the same between its two positions to operate said switch in response to a change in the level of said vacuum source between first and second vacuum levels, an atmospheric bleed orifice for said first vacuum motor, and valve means operated by said second vacuum motor responsive to variations in the level of said vacuum source above said second level to move to open and closed positions for respectively connecting and disconnecting said first vacuum motor and said atmospheric bleed orifice to shift the vacuum operating range of said first vacuum motor during variations in the level of said vacuum source above said second level, said valve means including a seating area acted on substantially by vacuum when the valve means is closed and atmospheric pressure when the valve means is open to provide a hysteresis effect for said valve means.

4. A vacuum actuated snap action switch comprising; first and second electrical switch contacts; snap action spring means connected to one of said switch contacts and having a first position urging said one switch contact into closing relation relative to said other switch contact and a second position urging said one switch contact into an open relation relative to said other switch contact; first vacuum motor means connected to said snap action spring and being responsive to a source of vacuum for moving said spring to said first position at a first predetermined vacuum level and for moving said spring to said second position at a second predetermined vacuum level higher than said first predetermined vacuum level when the vacuum level is increasing from said first predetermined level to said second predetermined level; second vacuum motor means responsive to a higher vacuum level than said first vacuum motor means, and valve means operated by said second vacuum motor means for connecting said first vacuum motor means to atmospheric pressure through a fixed bleed orifice for causing said first vacuum motor means to move said snap action spring to said first position at a third predetermined vacuum level higher than said second predetermined level and for connecting said first vacuum motor to the vacuum source to cause said first vacuum motor to move said snap action spring to said second position when the vacuum level is decreasing from said third predetermined level to said first predetermined level.

* * * * *